United States Patent [19]

Pink

[11] Patent Number: 4,494,456

[45] Date of Patent: Jan. 22, 1985

[54] CONVEYOR BELT APPARATUS

[75] Inventor: Frederick C. Pink, Franklin, Mass.

[73] Assignee: Component Marking Systems, Inc., Norwood, Mass.

[21] Appl. No.: 294,630

[22] Filed: Aug. 20, 1981

[51] Int. Cl.[3] ..... B41F 17/00

[52] U.S. Cl. ..... 101/35; 198/648; 198/813; 198/836

[58] Field of Search ..... 101/35, 37, 40, 44; 198/648, 681, 685, 813, 817, 836, 837

[56] References Cited

U.S. PATENT DOCUMENTS

| | | | |
|---|---|---|---|
| 2,859,689 | 11/1958 | Ackley | 101/35 |
| 2,931,292 | 4/1960 | Ackley | 101/37 |
| 3,272,118 | 9/1966 | Ackley | 101/37 |
| 3,342,304 | 9/1967 | Greulich | 198/648 X |
| 3,610,407 | 10/1971 | Prodzenski | 198/648 |
| 3,773,166 | 11/1973 | Nowacki | 198/837 X |
| 4,254,704 | 3/1981 | Ackley, Sr. et al. | 101/37 |
| 4,284,192 | 8/1981 | Taylor | 198/813 |

FOREIGN PATENT DOCUMENTS

| | | | |
|---|---|---|---|
| 2714273 | 2/1978 | Fed. Rep. of Germany | 198/648 |

*Primary Examiner*—Clifford D. Crowder
*Attorney, Agent, or Firm*—Jerry Cohen

[57] ABSTRACT

In a system for individually marking electrical or mechanical components a conveyor belt apparatus for delivering the components to and from a marking device for marking thereby including first and second elongated, closed loop, endless belt elements spaced side by side in a parallel arrangement and adapted to be synchronously driven in a tractor-like manner and a carrier assembly for carrying the components to be marked including a longitudinal (in the direction of belt elongation) series of short length plate members for mounting to the first and second belt elements thereby forming a tractor belt with the belt elements and interchangeable upper members removably mounted to the plate member, each upper member holding a component thereon at least while the conveyor belt apparatus is delivering components.

23 Claims, 17 Drawing Figures

Fig. 13 →
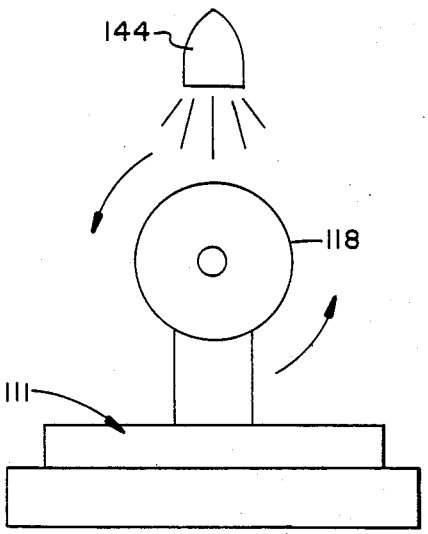
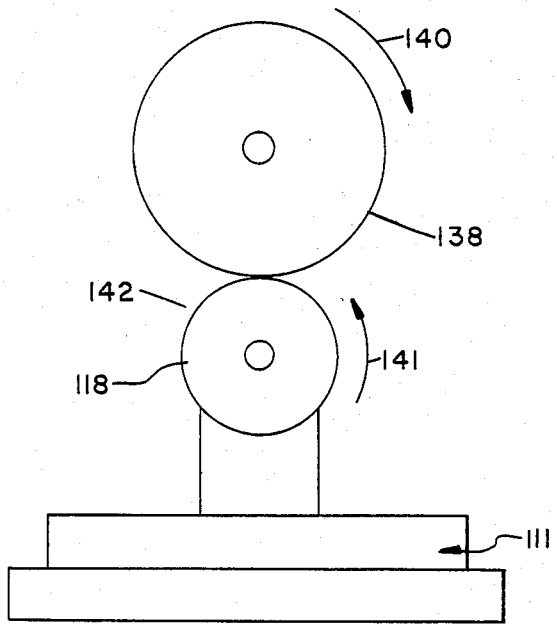
Fig. 14
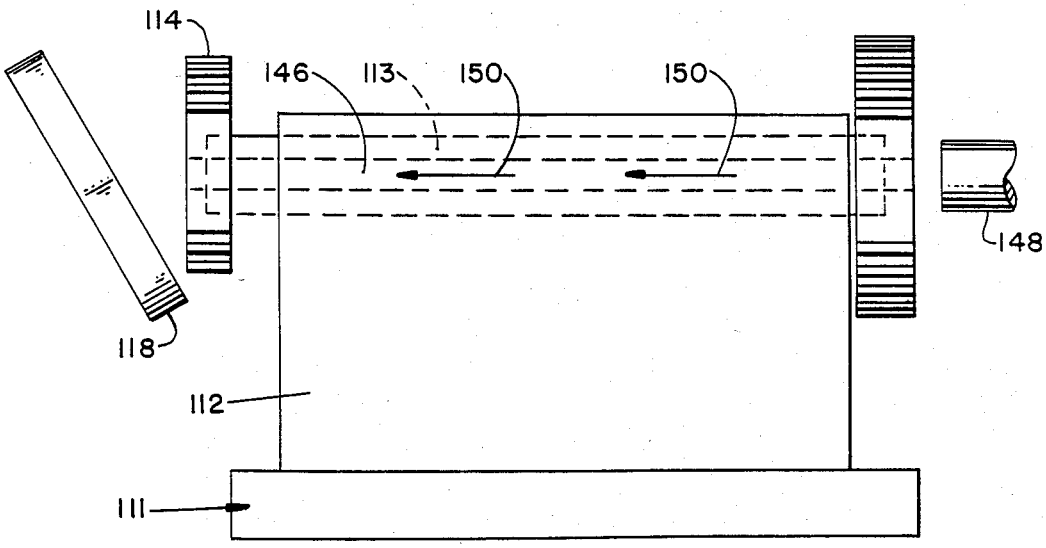
Fig. 15

CONVEYOR BELT APPARATUS

BACKGROUND OF THE INVENTION

This invention relates to a conveyor belt apparatus for delivering electrical or mechanical components to a marking device.

Electrical and mechanical components are presently marked by marking systems which utilize conveyor systems of various types to transfer the components to and from a marking device. A significant disadvantage of such systems is illustrated when the system is converted to accommodate a different type of component. Typically the conveyor system utilizes a component accomodating element such as a nest or carrier assembly mounted to a belt. The nest typically carries only one type of component and thus must be changed to correspond to a new component.

Changeover of nest elements is quite costly and time consuming. Either the conveyor belt must be taken apart to remove the old carrier element and replace it with a new one or the entire machine must be disassembled to remove the entire belt and replace it with a new one. Such changeover results in significant "down time" for the marking system. Further, frequent changeover of carrier elements and the rushing involved in the changeover may result in carrier components being lost or inadequately mounted to the belt resulting in system malfunction, breakdown and further delay.

SUMMARY OF INVENTION

Therefore it is a purpose of this invention to provide an improved conveyor belt apparatus for use in a component marking system which may be quickly, simply and inexpensively assembled, disassembled, and repaired.

It is a further object of this invention to provide a conveyor belt apparatus and a marking system incorporating the same in which the belt apparatus is designed to be quickly, inexpensively and completely interchanged in order to accommodate different components thereby eliminating the need for disassembling the belt apparatus in order to replace parts thereof.

It is a further object of this invention to provide a carrier assembly for use in the conveyor system of a component marking system having an improved means for securely mounting to belt elements of the conveyor system.

It is a further object of this invention to provide a carrier assembly in a conveyor system of a component marking system having interchangeable parts for accommodating a wide variety of components.

It is a further object of this invention to provide for a carrier assembly for use in a conveyor system and the marking system incorporating the same which provide for improved cleaning, marking, and drying of the components.

It is a further object of this invention to provide an improved component marking system which provides for rapid and inexpensive conveyor changeover.

This invention features a carrier assembly for carrying electrical or mechanical components which may be incorporated in a conveyor system for delivering such components to a marking device for individual marking of the components by the device. In particular the carrier of this invention is suited for use in conveying systems which include first and second elongated closed loop endless belt elements which are spaced side by side in a parallel arrangement and adapted to be synchronously driven in a tractor-like manner.

The carrier assembly may include a plate member for straddling the outwardly facing surfaces of the two belt members. Multiple mounting arms are spaced from the inwardly facing surface of the plate member and extend laterally thereto. The carrier includes means interconnecting the mounting arms and the plate member. Preferably such means include a beam depending from the inwardly facing surface of the plate member, extending substantially the length thereof and fitting in the space between the belt elements. At least one mounting arm may extend from each lengthwise side of the beam. Each arm includes a groove therein for receiving one tooth of either of the belt elements. At least one tooth of each belt element is so received. In a typical embodiment one arm extends from each side of the beam; a first arm receives a tooth of the first belt element and a second arm receives a tooth of the second belt element. The first and second mounting arms are typically aligned. It is preferred that the plate number, beam and mounting arms comprise one integral member composed of molded plastic or comparable material. The plate member may include one or more openings in which are recessed portion of the belt elements between the mounting arms and plate member. This structure restricts lateral movement of the plate member with respect to the belt elements.

In one embodiment of this invention the plate member may carry a component to be marked on its outwardly facing surface. Alternatively an upper member may be removably mounted, such as by screws inserted through cooperating holes in the plate and upper members, or other acceptable means to the plate member. The upper member has accommodating means for holding at least one component thereon at least while the conveyor system is delivering components.

The upper member is typically composed of plastic or similar material. The accommodating means may include a recess in the upper member for receiving a component. Alternatively any suitable method or structure for holding a component for marking is acceptable. Such a structure will be described hereafter in conjunction with a marking system which incorporates this carrier assembly.

In a third embodiment of the carrier of this invention at least one pin member is removably mounted to the plate member and extends outwardly therefrom. A component may be placed longitudinally (in the direction of belt drive) forward of the pin member, either directly on the plate member or alternatively mounted as will be described hereafter in conjunction with a conveyor belt and marking system incorporating this carrier. This placement enables the pin member to urge the component longitudinally forward as the belt elements are driven.

This invention also features a conveyor belt apparatus for use in a system for marking electrical or mechanical components. The conveyor belt apparatus includes first and second endless belt elements spaced side by side in a parallel arrangement and adapted to be synchronously driven in a tractor like manner. Carrier means carry the components and include a series of short length, plate numbers for mounting to the belt elements thereby forming a tractor belt with the belt elements.

Removably mounted to the plate members may be either upper members or pin members as heretofore described as provided in the carrier assembly of this invention.

It is preferred that the plates and belt elements be structured and mounted together as has previously been described for the individual carrier assembly of this invention. Alternative means of mounting and cooperation are acceptable. The belt should exhibit both flexibility and strength in order to operate effectively over extended periods of time. A typical belt may be neoprene or urethane backed. Flexible steel chords may be embedded longitudinally through the belt for reinforced strength. Typically the teeth of the belt will be spaced ½" apart.

In the pin member embodiment of this invention the conveyor belt apparatus may further include first and second rail elements spaced parallel to each other and suspended above and substantially parallel to an outwardly and substantially upwardly facing surface of the tractor belt. The rail members have outwardly facing surfaces for accommodated components and the pin members extend through the space between the rail elements to a height above that of the outwardly facing surfaces thereof, thereby enabling the pins to urge the components longitudinally along the rail elements as the tractor belt is driven.

Guide means may further be provided for restricting lateral movement of the conveyor belt apparatus.

Additionally this invention features marking systems incorporating either of the conveyor belt apparatus and carrier assemblies of this invention and each of the features or embodiments thereof. The systems also include means for marking the components, drive means for driving the conveyor belt apparatus and synchronization means for synchronizing operation of the drive means and means for marking for enabling the means for marking to mark each component as the component is delivered thereto.

The marking system may include belt tensioning means for decreasing tension on the belt elements for belt removal and for increasing the tension for belt driving.

The drive means may include a drive motor for operating pulley means which cooperate with the tractor belt. The tensioning means may include an air cylinder. Typically the drive and belt tensioning means are situated substantially inside of the closed loop and thus do not interfere with belt removal.

The marking system of this invention may exhibit the following features which call for the use of the following described carrier assembly: The means for marking may include a rotatable marking head. The system may include a first rack and wiping means and/or a second rack and drying means. For such embodiments the upper member's accommodating means may include support means, a shaft rotatably mounted to the support means and a retaining wheel mounted to one end of the shaft for rotatably holding a component thereon. Such an upper member may further include a gear element on the other end of the shaft. Such an upper member may further include a gear element on the other end of the shaft. The rotatable mounting of the component allows the component to rotatably engage the rotatable marking head to insure even, smooth and clear marking. The gear element is provided to mesh with the first rack means and/or the second rack means. This meshing rotates the retaining wheel (via the shaft) and the component thereon so that the component will be wiped clean by the wiping means prior to marking and dried by the drying means (typically an ultraviolet light source) following marking.

The retaining wheel may include a number of radial projections extending from the circumference thereof for cooperating with complementary projections on the radial surface of the component mounted thereto thereby enabling rotating cooperation between the wheel and component. Further, the shaft may include a longitudinal bore and the marking system may include blower means for aligning with the bore and directing a jet of air therethrough following marking in order to discharge the component from the retaining wheel.

Pulley means may be provided for cooperating with the inwardly facing surfaces of the belt elements. In the spaced tooth belt element embodiment the pulley means may include first and second circumferential surfaces having evenly spaced relatively narrow notches for engaging the teeth of the first and second belt elements. Where two aligned mounting arms are used the pulley surfaces will have periodically spaced relatively wide notches for receiving the mounting arms. The pulley means may include a relieved portion between the two notched surfaces for accommodating the carrier assembly beams.

Utilization of the carrier assemblies, conveyor belt apparatus and marking systems of this invention provides several distinct advantages over the prior art. Versatility in component marking is greatly increased. Wide varieties of components, of all shapes and sizes, can be marked. Belt changeover time is greatly reduced. Rather than replacing individual carrier assemblies, as is presently done, the entire conveyor belt apparatus is replaced. Mass production and low expense of the individual parts make it feasible to maintain numerous varieties of belts. The interchangeable upper and pin members and the universal plate member provide for ready alteration of the belts, if required. Placement of marking system elements within the closed loop belt hastens belt changeover. The rotatable component feature allows component wiping, drying and clean marking.

Other objects, features and advantages of the invention will become apparent from the following detailed description of preferred embodiments with reference therein to the accompanying drawings in which:

BRIEF DESCRIPTION OF THE DRAWINGS

FIG. 13 is a simplified side elevational view of a component mounted to the upper member of FIG. 10 being marked by a rotating marking head;

FIG. 14 is a simplified side elevational view of a component mounted to the upper member of FIG. 10 being dried by drying means according to this invention;

FIG. 15 is a simplified front cross sectional view of means for discharging a component from the upper member of FIG. 10;

DETAILED DESCRIPTION OF PREFERRED EMBODIMENTS

Figure 1:
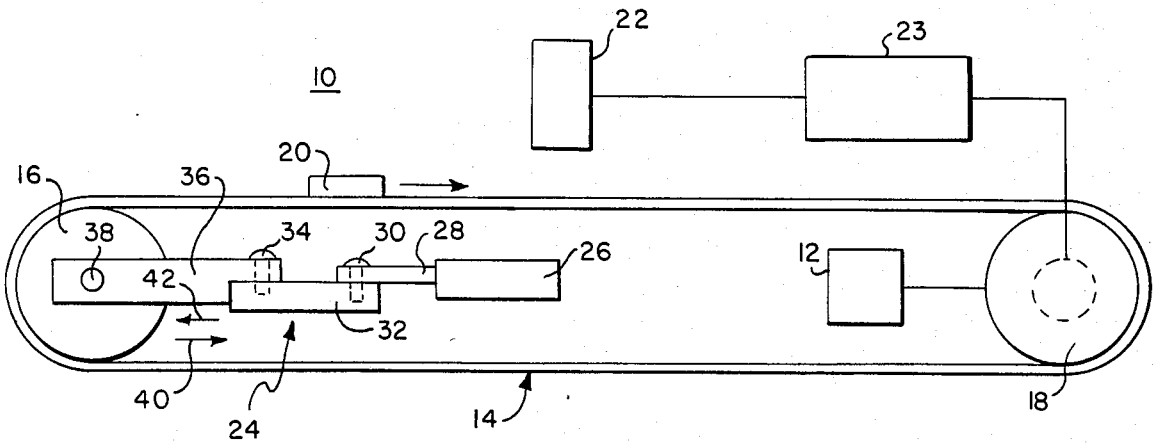
FIG. 1 is a schematic view of a system for marking electrical or mechanical components according to this invention.

There is shown in FIG. 1 a marking system 10 according to this invention wherein driving means 12 are provided to endless closed loop conveyor belt apparatus 14 in a tractor-like manner. Apparatus 14 is driven around pulleys 16 and 18 so that an electrical or mechanical component 20 may be delivered to and from a position proximate means for marking 22 in order to be marked thereby. Drive means 12, means for marking 22 and synchronizing means 23 for synchronizing operation of the marking means 22 with that of the belt 14 are all of conventional structure and operation in conveyor belt/marking system art. Drive means 22 typically include a drive motor, drive belt and drive pulley attached to pulley 18 for driving thereof. In this manner pulley 18 drives apparatus 14.

Belt tensioning means 24 are provided for loosening or tightening pulley 16. An air cylinder 26 includes a piston rod 28 interconnected by pin 30 to slide member 32 which in turn is interconnected by pin 34 to pulley arm 36. Arm 36 is in turn interconnected to pulley 16 by shaft 38. As rod 28 is retracted within cylinder 26 pulley 16 is withdrawn in the direction of arrow 40 thereby loosening belt 14 for removal thereof. To retighten belt apparatus 14 the slackened belt is positioned around pulley 16. Rod 28 is extended from cylinder 26 to urge pulley 16 in the direction of arrow 42 thereby tensioning apparatus 16 for driving thereof.

Both drive means 12 and belt tensioning means 24 are located inside the closed loop of apparatus 16. This feature reduces interference of these elements with belt removal and replacement thereby reducing the time required for belt changing.

Figure 2:
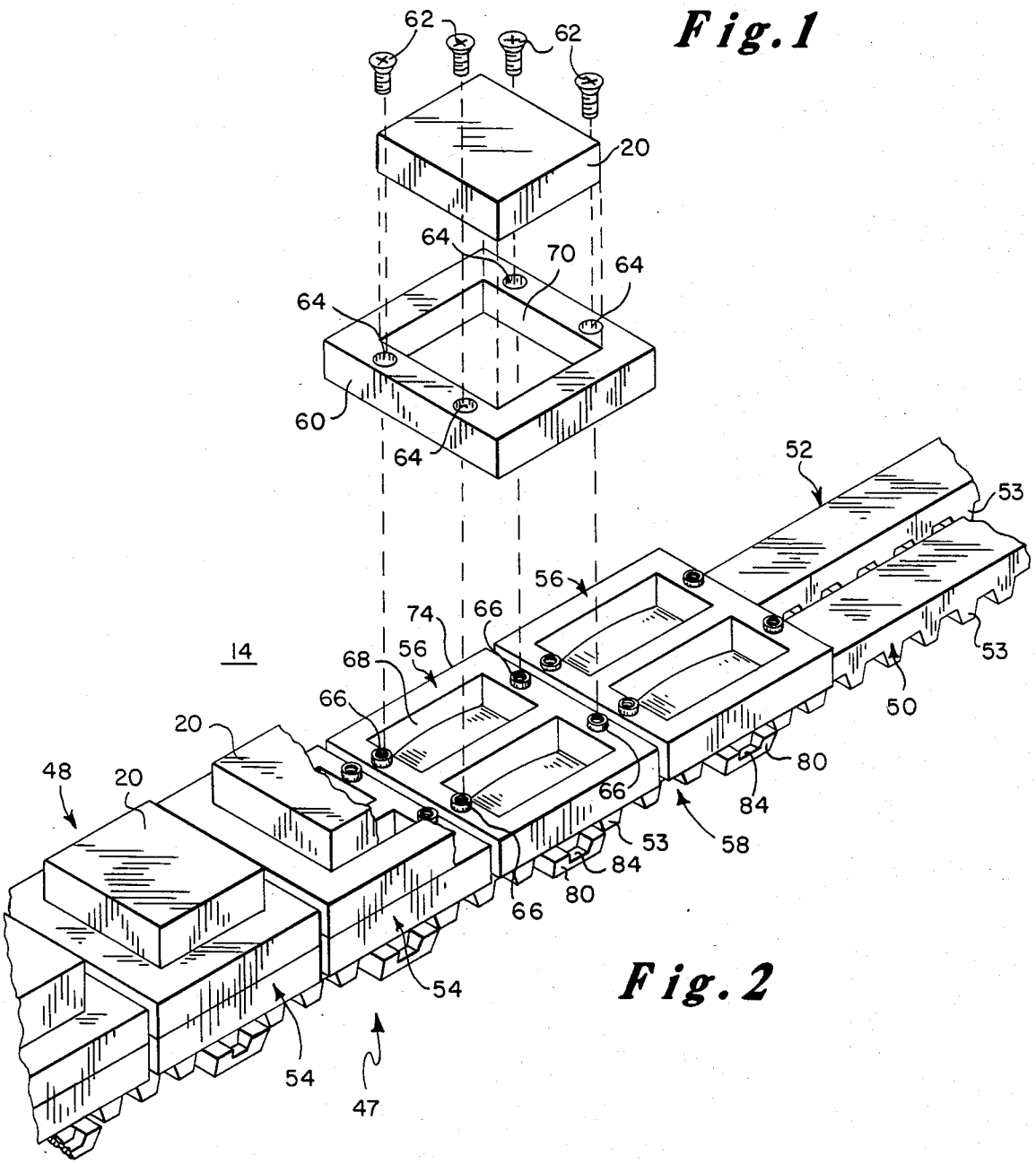
FIG. 2 is a partially exploded isometric view of a portion of a conveyor belt apparatus according to this invention.

In one embodiment of this invention a portion of belt apparatus 4 is shown in FIG. 2. Inwardly facing side 47 refers to the inside of the closed loop and outwardly facing side 48 refers to the outside of the closed loop (See also FIG. 1).

Endless elongated closed loop belt elements 50 and 52 are spaced side by side in a parallel arrangement. Each element has a series of inwardly facing teeth 53 spaced along the length thereof and extending substantially the width thereof. Carrier assemblies 54 for carrying components 20 include a series of short length (in the direction of belt elongation) plate members 56 which are removably mounted to belt elements 50 and 52 to form a tractor belt 58. Belt apparatus 14 is completed by upper members 60 which are removably mounted to plate members 56. Typically, attachment is performed by one or more screws or pins 62 extending through cooperating holes 64 in member 60 and 66 in plate 56. Each plate 56 includes openings 68 therein. Each upper member 60 has a recess 70 for receiving component 20 and for keeping the component in place prior to and during marking.

Figure 3:
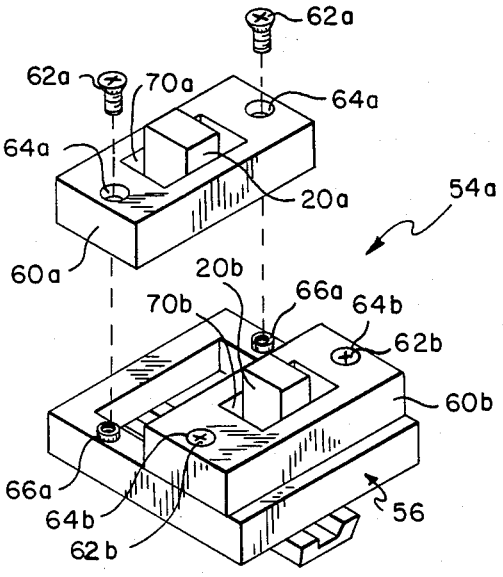
FIG. 3 is an isometric view of one embodiment of a carrier assembly of this invention.

FIG. 3 shows an alternative carrier assembly 54*a* (belt elements and assembly mounting thereto omitted for clarity) in which two upper members 60*a* and 60*b* are removably mounted to plate 56. Connecting pins 62*a* extend through holes 64*a* in member 60*a* and cooperating holes 66*a* in plate 56. Cooperating pins 62*b* extend through holes 64*b* in member 64*b* and obscured cooperating holes in plate 56. Members 60*a* and 60*b* include recesses 70*a* and 70*b* for receiving components 20*a* and 20*b*.

Figure 4:
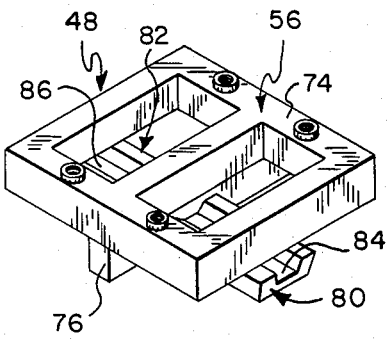
FIG. 4 is an isometric view of the outward facing surface of a plate member used in the carrier assemblies of this invention.
Figure 5:
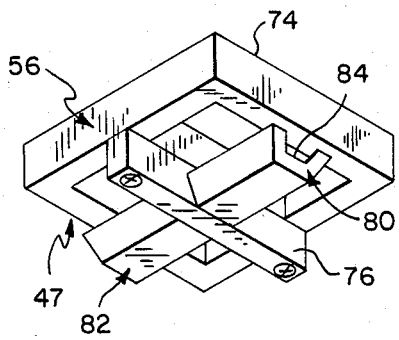
FIG. 5 is an isometric view of the inward facing surface of the plate member shown in FIG. 4.

An individual plate 56 is shown in FIGS. 4 and 5. FIG. 4 provides a view of outside facing surface 48 while FIG. 5 illustrates inside facing surface 47.

Figure 6:
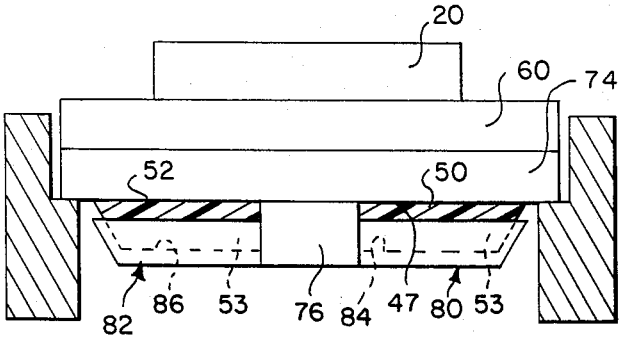
FIG. 6 is an elevational cross sectional view of the conveyor belt apparatus of this invention looking lengthwise along the apparatus.

Referring to FIGS. 2 and 4–6 simultaneously note that each plate includes a substantially flat portion 74 which straddles elements 50 and 52. A beam 76 is secured, typically integrally to inward surface 47 and extends substantially the length of flat portion 74, fitting into the space between elements 50 and 52, as shown in FIG. 6. Extending laterally from beam 76, and integral thereto, are mounting arms 80 and 82. As shown, in FIGS. 4–6 these arms are typically aligned, although they may be acceptably non aligned but still lateral to beam 76 (i.e., to form a Z-configuration with beam 76). Arms 80 and 82 include longitudinal grooves 84 and 86 respectively. Each groove receives one tooth 53 of elements 50 and 52.

Figure 7:
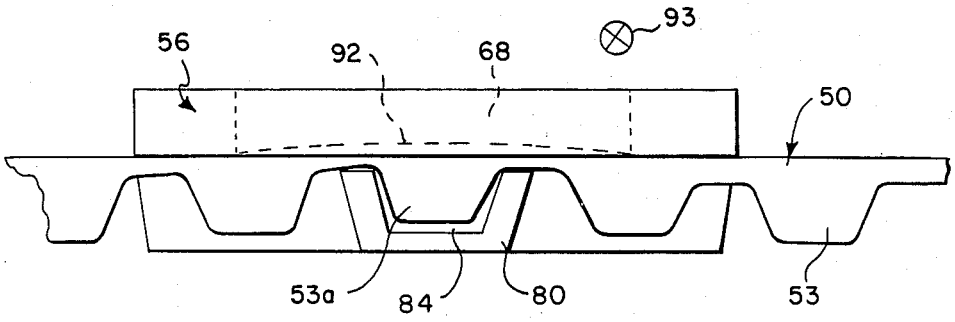
FIG. 7 is a side elevational view of the tractor belt viewed from the right of FIG. 6.

Tooth/groove cooperation is more clearly shown in FIG. 7. Therein the upper member is removed for clarity. Further only element 50, and teeth 53 thereof, and arm 80 are visible. Element 52 and arm 82 are located on the opposite side of beam 76 and are thus obscured thereby. The tight fit of tooth 53*a* in groove 84 causes a portion 92 of belt element 50 to bulge slightly into opening 68 of plate 56. Belt element 50 is thereby prevented from slipping laterally out of groove 84 in the direction of arrow 93.

Figure 8:
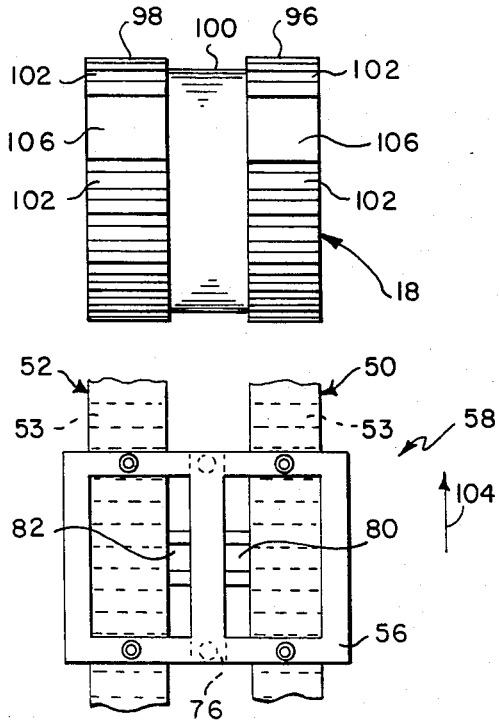
FIG. 8 is a simplified top cross sectional view of the tractor belt of this invention and a pulley with which it cooperates.
Figure 9:
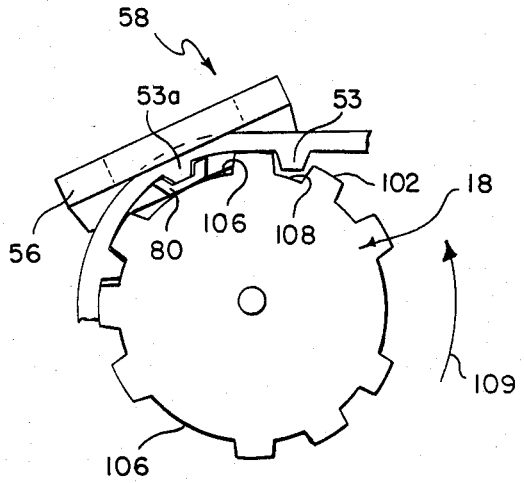
FIG. 9 is a side view illustrating the cooperation of the pulley and tractor belt shown in FIG. 8.

FIGS. 8 and 9 illustrate how tractor belt 58 is driven. In both figures the upper member is again omitted for clarity.

In FIG. 8 the section of belt 58 engaging pulley 16 is likewise omitted. Further, only one plate 56 is pictured although typically a series of end to end plates is provided as in FIG. 2. Pulley 18 (and pulley 16 by analogy) includes toothed portions 96 and 98 and relieved portion 100. Portions 96 and 98 include teeth 102 on the circumferential surfaces thereof. Teeth 102 on portion 96 cooperate with teeth 53 of belt element 50 and teeth 102 of portion 98 cooperate with teeth 53 of belt element 52. As pulley 18 rotates it thereby drives tractor belt 58 in the direction of arrow 104. Relieved portion 100 accommodates beam 76.

In each of the portions 96 and 98 a series of relatively wide notches 106 is spaced around the portion circumference. These notches are typically formed by removing every fourth tooth 102. Otherwise the remaining teeth 102 are evenly spaced. Notches 106 accommodate mounting arms 80 and 82.

FIG. 9 shows more clearly cooperation between tractor belt 58 and pulley 18. Teeth 53 are accommodated by narrow notches 108 between teeth 102 of pulley 18 whereas tooth 53*a* and grooved arm 80 are accommodated in wide notch 106. Pulley 18 rotates in the direction of arrow 109 thereby driving tractor belt 58.

Figure 10:
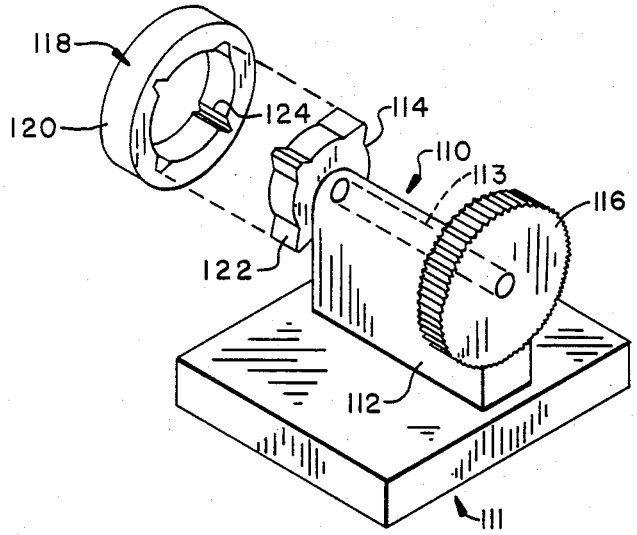
FIG. 10 is an alternative embodiment of the upper member.

An alternative embodiment of this invention is shown in FIG. 10. Component accommodating means 110 of upper member 111 includes a support 112, a shaft 113 rotatably mounted to the support and a retaining wheel 114 mounted at one end of shaft 113. A geared wheel 116 is mounted at the other end of the shaft. A cap component 118 fits onto wheel 114. Lip 120 of component 118 encircles wheel 114. Wheel 114 has circumferential radial projections 122 for engaging complementary radial ribs 124 on the inside of surface of component 118 thereby enabling component 118 to rotate with wheel 114.

Figure 11:
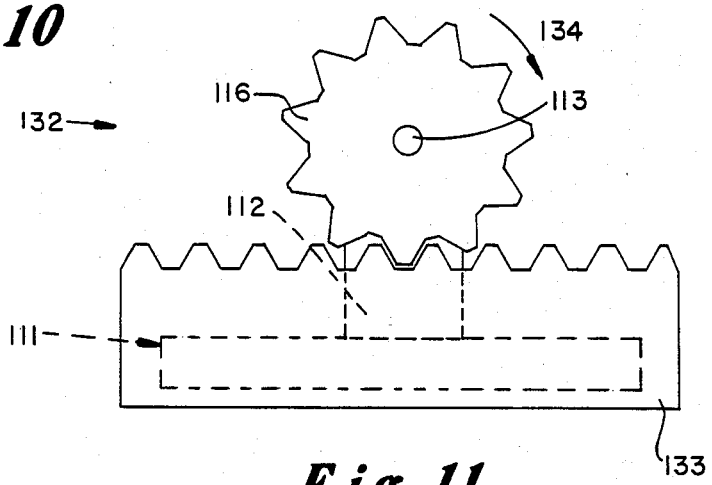
FIG. 11 is a simplified side elevational view of the geared wheel of the upper member of FIG. 10 meshing with rack means of this invention.
Figure 12:
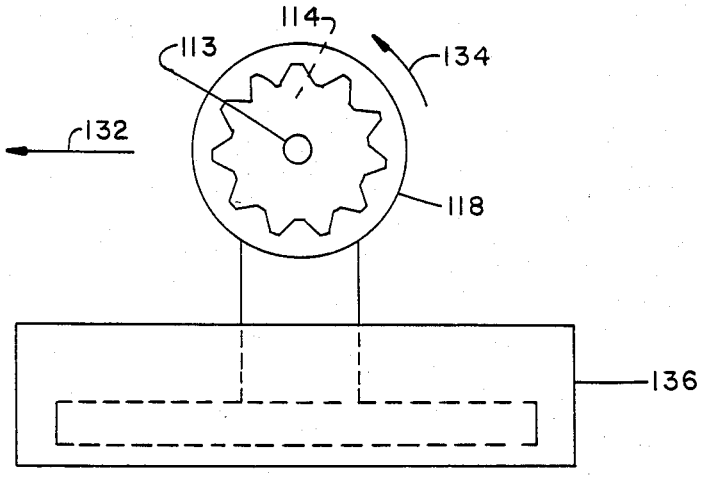
FIG. 12 is a simplified side elevational view of a component mounted to the upper member of FIG. 10 being cleaned by wiper means of this invention.

The remainder of the conveyor belt apparatus is structured and functions as has been heretofore described. This upper member 111 operates in a marking system, such as system 10 of FIG. 1, as follows: In this description only the upper member 111 and other non conventional relevant parts are shown for clarity. As shown in FIG. 11 the carrier assembly including upper member 111 is driven (as part of apparatus 14) in the direction of arrow 132. Rack means 133 is mounted by any appropriate means at a point in the path of the conveyor belt prior to the point of marking (i.e., to the left of marking means 22 of FIG. 1). Rack 133 may be disposed horizontally as shown or vertically or angled to accommodate vertical or angular travel by the conveyor belt apparatus. As gear 116 engages rack 133, gear 116 is rotated in direction 134. Shaft 113 is similarly rotated as is retaining wheel 114 and component 118 thereon, see FIG. 12. Wiping means 136 is mounted, again in any appropriate fashion in the conveyor belt path (or again disposed horizontally, vertically, or at an angle) so that rotating component 118 will wipe against it and be cleaned thereby.

Component 118 next proceeds as shown in FIG. 13 to engage rotating marking head 138 (again mounted in a conventional manner at a conventional location in the system). As head 138 rotates in direction 140, component 118 will rotate in direction 141 and the required marking will be transferred from head 138 to the circumference 142 of component 118, e.g., to the outside surface of the lip shown in FIG. 9.

Following marking of component 118 the unpictured tractor belt carrying upper member 111 delivers member 111 to a point where gear 116 engages a second rack means (similar to that shown in FIG. 11 but now situated on the right side of the printing head of FIG. 1) for turning gear 116 as shown in FIG. 11. Component 118 is rotated thereby as shown in FIG. 14 so that the marking print on circumference lip 120 is dried by drying means such as ultraviolet light 144.

Following drying, as shown in FIG. 15, upper member 111 is delivered to a point at which longitudinal bore 146 of shaft 113 receives a burst of air from a blower or jet 148 of conventional means. The air flows through bore 146 in the direction of arrow 150 thereby discharging component 118 from retaining wheel 114.

Figure 16:
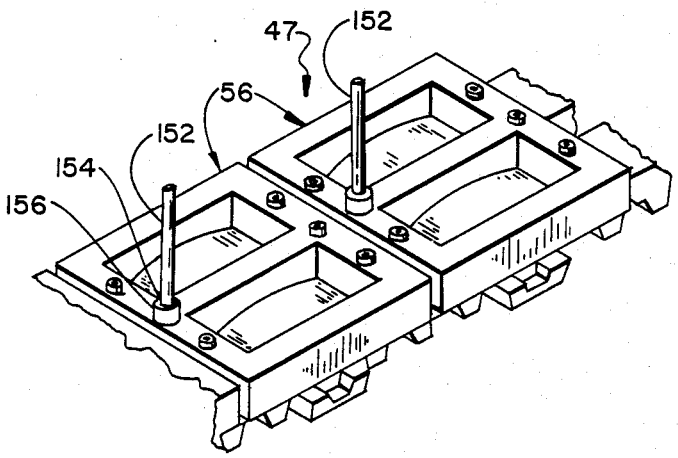
FIG. 16 is an isometric view of a portion of an alternative embodiment of the conveyor belt apparatus of this invention using pin members.

In an alternative embodiment, FIG. 16, pin members 152 may be mounted into holes 154 of plate members 56. Holes 154 are typically encircled by collars 156. Preferably pins 152 are simply pressed or pushed into holes 154 although threaded attachment may be provided. Pins 152 extend outwardly from side 47 of plates 56 and are arranged one pin per plate in a generally longitudinal array. Spacing between the pins allows for component placing therebetween (not shown). The components are thereby held substantially in place during delivery to the means for marking.

Figure 17:
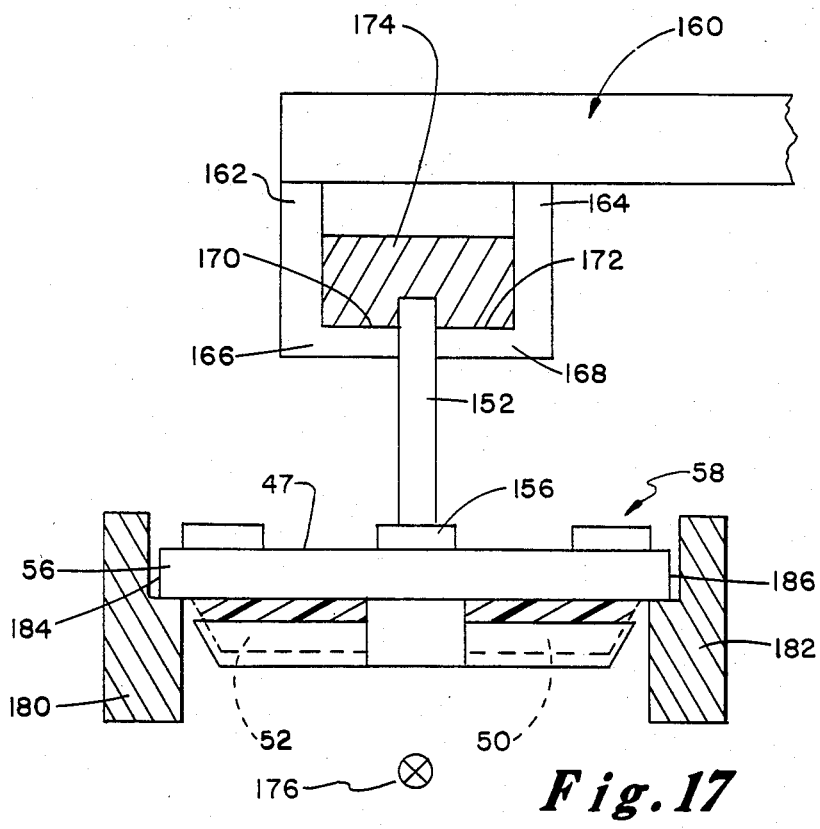
FIG. 17 is a simplified elevated cross sectional view lengthwise along the conveyor belt apparatus of FIG. 16 employing rail members for molded components guiding.

The arrangement shown in FIG. 17 is typically provided for use in embodiments using pin members 152. A support structure 160 is mounted in any appropriate manner to a conventional structure surrounding the tractor belt. Depending from support 160 are suspension members 162 and 164 which hold rail elements 166 and 168 which are spaced above the outwardly facing surface 47 of plate member 56 and which extend substantially parallel thereto. On outwardly facing surfaces 170 and 172, rail elements 166 and 168 accommodate component 174. Pin 152 extends above surfaces 170 and 172. When belt elements 50, 52 are driven in the direction of arrow 176 pin 152 pushes component 174 along rails 166 and 168 in a like direction thereby delivering compoment 174 as required.

FIG. 17 also shows guide members 180 and 182 which include longitudinal channels 184, 186 for accommodating plate member 56 and preventing lateral motion by tractor belt 58. Such guides may be used in any embodiment of the tractor belt, conveyor belt apparatus or marking system of this invention.

It is evident that those skilled in the art, once given the benefit of the foregoing disclosures, may now make numerous other uses and modifications of, and departing from, the specific embodiments described herein without departing from the inventive concepts. Consequently, the invention is to be construed as embracing each and every novel feature and novel combination of features present in, or possessed by, the apparatus and techniques herein disclosed and limited solely by the spirit and scope of the appended claims.

What is clamied is:

1. In a conveyor system for delivering electrical or mechanical components to and from a marking device for individual marking thereof having first and second elongated closed loop endless belt elements spaced side by side in a parallel arrangement, each having a plurality of inwardly facing teeth spaced along the length thereof and being adapted to be synchronously driven in a tractor-like manner, a carrier assembly for carrying the components comprising a short length plate member for straddling the outwardly facing surfaces of the first and second belt elements, multiple mounting arms spaced from the inwardly facing surface of said plate member and extending substantially laterally thereto, each mounting arm having a longitudinal groove therein for receiving a tooth of either the first or second belt element, at least one tooth of each belt element being so received, means interconnecting said mounting arms and said plate member, and at least one upper member removably mounted to said plate member and each having accommodating means for holding a component thereon, at least while the conveyor system is delivering the component.

2. The carrier assembly of claim 1 wherein said accommodating means include recess means for receiving a component.

3. In a conveyor system for delivering electrical or mechanical components to and from a marking device for individual marking thereof having first and second elongated closed loop endless belt elements spaced side by side in a parallel arrangement, each having a plurality of inwardly facing teeth spaced along the length thereof and being adapted to be synchronously driven in a tractor-like manner, a carrier assembly for carrying the components comprising a short length plate member for straddling the outwardly facing surfaces of the first and second belt elements and for carrying at least one component on the outward facing surface of said plate member, multiple mounting arms spaced from the inwardly facing surface of said plate member and extending substantially laterally thereto, said mounting arms each having a longitudinal groove therein for receiving a tooth of either the first or second belt element, at least one tooth of each element being so received, and means interconnecting said mounting arms and said plate member.

4. The carrier assembly of either of claims 1, or 3 wherein said means interconnecting said mounting arms and said plate member include a beam depending from the inwardly facing surface of said plate member and extending substantially the length thereof, said beam fitting longitudinally between said belt elements when said plate member straddles the outwardly facing surfaces thereof, at least one mounting arm extending from each of the opposite sides of said beam.

5. The carrier assembly of claim 4 wherein first and second mounting arms depend from said plate member, said first mounting arm groove receiving a tooth of said first belt element and said second mounting arm groove receiving a tooth of said second belt element.

6. The carrier assembly of claim 5 wherein said first and second mounting arms and the grooves therein are substantially aligned.

7. The carrier assembly of claim 4 wherein said plate member, said mounting arms and said beam comprise one integral member.

8. The carrier assembly of either of claims 1, or 3 wherein said plate member includes at least one opening therein for receiving a portion of said belt elements thereby restricting lateral movement of said plate member thereon.

9. The carrier assembly of either of claims 1, or 3 wherein said plate member and said upper member include cooperating holes for receiving connecting elements therein.

10. In a system for individually marking electrical or mechanical components a conveyor belt apparatus for delivering the components to and from a marking device for marking thereby comprising, means defining first and second elongated, closed loop, endless belt elements spaced side by side in a parallel arrangement, each belt including multiple inwardly facing teeth spaced along the length thereof and being adapted to be synchronously driven in a tractor-like manner, and a carrier assembly for carrying the components to be marked including a longitudinal series of short length plate members, each plate member straddling the outwardly facing surfaces of said belt elements, a beam depending from the inwardly facing surface of each plate member, said beam extending substantially the length of said plate member for fitting longitudinally in the space between the first and second belt elements, and first and second mounting arms extending laterally outwardly from each said beam, said first mounting arm having a groove therein for receiving a tooth of said first belt element and said second mounting arm having a groove therein for receiving a tooth of said second belt element thereby forming a tractor belt with said belt elements, and interchangeable upper members removably mounted to said plate members. each upper member having accommodating means for holding a component thereon, at least while said conveyor belt is delivering components.

11. The conveyor belt apparatus of claim 10 wherein said first and second mounting arms are substantially aligned.

12. The conveyor belt apparatus of claim 10 wherein each said plate member includes at least one opening.

13. The conveyor belt apparatus of claim 10 wherein said plate member, beam, and mounting arms comprise one integral member.

14. The conveyor belt apparatus of claim 10 further including guide means for restricting lateral movement of said tractor belt.

15. The conveyor belt apparatus of claim 10 wherein said accommodating means include recess means for receiving a component.

16. The conveyor belt apparatus of claim 10 wherein said plate member and said upper member include cooperating holes for receiving connecting elements therein.

17. A system for individually marking electrical or mechanical components comprising means for marking;

a conveyor system for delivering the components to and from said means for marking including means defining first and second elongate, closed loop endless belt elements spaced side by side in a parallel arrangement, pulley means, each belt element including a plurality of inwardly facing teeth spaced along the length thereof and said pulley means including a pair of geared circumferential surfaces for cooperating with said belt element teeth, drive means for synchronously driving said first and second belt elements in a tractor like manner and a carrier assembly for carrying the components including a longitudinal series of short length plate members for mounting to said belt elements, a beam depending from the inwardly facing surface of each plate member and extending substantially the length thereof for fitting longitudinally in the space between said first and second belt elements and first and second mounting arms extending laterally outward from said beam in a substantially aligned manner, said first mounting arm having a groove therein for receiving a tooth of said first belt element and said second mounting arm having a groove therein for receiving a tooth of said second belt element and wherein said geared circumferential pulley surfaces include relatively wide notches periodically spaced about said surfaces for receiving said mounting arms and further include relatively narrow notches interposed between each wide notch for receiving said belt element teeth.

18. The system of claim 17 further including belt tensioning means for increasing tension on said belt elements for belt removal and for decreasing tension on said belt elements for belt driving, wherein said belt tensioning means is situated substantially within the closed loop of said tractor belt.

19. The marking system of claim 18 wherein said belt tensioning means include an air cylinder.

20. The marking system of claim 17 wherein said drive means is situated substantially within the closed loop of said tractor belt.

21. The marking system of claim 17 wherein said means for marking include a rotatable marking head.

22. The marking system of claim 17 wherein said accommodating means include recess means for receiving a component.

23. The marking system of claim 17 wherein said pulley means include a relieved circumferential portion between said notched portions for receiving said beam.

* * * * *